US011572656B2

(12) United States Patent
Correia et al.

(10) Patent No.: US 11,572,656 B2
(45) Date of Patent: Feb. 7, 2023

(54) FIBRE ROPE AND HOISTING SYSTEM INCLUDING SUCH A FIBRE ROPE

(71) Applicant: National Oilwell Vareo Norway AS, Kristiansand S (NO)

(72) Inventors: Ricardo Nuno Correia, Kristiansand S (NO); Yngvar Borøy, Søgne (NO); Hugo Lacerda, Kristiansand (NO); Oddbjørn Øye, Kristiansand (NO)

(73) Assignee: National Oilwell Vareo Norway AS

( * ) Notice: Subject to any disclaimer, the term of this patent is extended or adjusted under 35 U.S.C. 154(b) by 918 days.

(21) Appl. No.: 16/335,181

(22) PCT Filed: Sep. 26, 2017

(86) PCT No.: PCT/NO2017/050246
§ 371 (c)(1),
(2) Date: Mar. 20, 2019

(87) PCT Pub. No.: WO2018/056838
PCT Pub. Date: Mar. 29, 2018

(65) Prior Publication Data

US 2021/0277598 A1 Sep. 9, 2021

(30) Foreign Application Priority Data

Sep. 26, 2016 (EP) ..... 16190590

(51) Int. Cl.
*D07B 1/14* (2006.01)
*B66C 1/12* (2006.01)
(Continued)

(52) U.S. Cl.
CPC ..... *D07B 1/145* (2013.01); *B66C 1/12* (2013.01); *B66C 15/00* (2013.01); *B66D 1/28* (2013.01);
(Continued)

(58) Field of Classification Search
CPC ..... D07B 1/025; D07B 1/145; D07B 1/148; D07B 2205/2014; D07B 2301/252;
(Continued)

(56) References Cited

U.S. PATENT DOCUMENTS 4,020,945 A * 5/1977 Takeno ..... B65G 43/02 198/810.02
4,438,402 A * 3/1984 Cullen ..... G01B 7/044 324/72
(Continued)

FOREIGN PATENT DOCUMENTS

CN 1270252 A 10/2000
CN 1108519 C 5/2003
(Continued)

OTHER PUBLICATIONS

Machine translation of CN 1835881, retrieved Aug. 17, 2022.*
(Continued)

*Primary Examiner* — Shaun R Hurley
(74) *Attorney, Agent, or Firm* — Conley Rose, P.C.

(57) ABSTRACT

There is described a hoisting system and method of lifting that make use of a particular fibre rope. The fibre rope includes a plurality of magnets that are embedded within the fibre rope and spaced apart along the rope with a known axial distance between the magnets. The system may include a fibre rope hoisting speed sensor, and a magnetic field sensor that can sense the presence of the magnetic field of the embedded magnets. Using the sensors, the hoisting speed of the rope may be determined by: measuring the time between the passing of consecutive magnets by using the magnetic field sensor; calculating the distance between consecutive magnets using the hoisting speed sensor and the measured time between the passing of the consecutive magnets;
(Continued)

and comparing the calculated distance between the magnets with an original, predefined distance between the magnets.

15 Claims, 7 Drawing Sheets

(51) Int. Cl.
*B66C 15/00* (2006.01)
*B66D 1/28* (2006.01)
*D07B 1/02* (2006.01)

(52) U.S. Cl.
CPC ..... *D07B 1/025* (2013.01); *D07B 1/148* (2013.01); *D07B 2205/2014* (2013.01); *D07B 2205/2039* (2013.01); *D07B 2205/3007* (2013.01); *D07B 2301/252* (2013.01); *D07B 2301/555* (2013.01); *D07B 2501/2015* (2013.01)

(58) Field of Classification Search
CPC ..... D07B 2301/555; B66C 1/12; B66C 15/00; B66D 1/28
See application file for complete search history.

(56) References Cited

U.S. PATENT DOCUMENTS 4,533,259 A * 8/1985 Wakahara ..... G01K 3/00 374/177
4,718,168 A 1/1988 Kerr
6,047,814 A * 4/2000 Alles ..... B65G 43/02 198/810.02
7,441,464 B2 * 10/2008 Turnbull ..... D07B 1/145 73/146
7,748,521 B2 * 7/2010 Aizawa ..... B65G 43/02 198/810.04
8,330,452 B2 * 12/2012 Furukawa ..... B65G 43/04 324/228
10,660,266 B2 * 5/2020 Wallace ..... A01D 34/40
2002/0090181 A1 * 7/2002 Rossi ..... G02B 6/447 385/100
2003/0111298 A1 * 6/2003 Logan ..... B66B 7/1238 187/391
2005/0063449 A1 * 3/2005 Lustenberger ..... G01N 25/72 374/45
2006/0219528 A1 10/2006 Aizawa
2008/0105059 A1 5/2008 Turnbull
2010/0035000 A1 * 2/2010 Kirth ..... D03D 23/00 428/221
2015/0198463 A1 * 7/2015 Weischedel ..... G01B 7/026 324/207.25
2016/0236913 A1 8/2016 Ilaka
2018/0079631 A1 * 3/2018 Borøy ..... B66C 23/52
2019/0293603 A1 * 9/2019 Itoi ..... G01N 27/83

FOREIGN PATENT DOCUMENTS

CN 1835881 A 9/2006
CN 103476697 A 12/2013
EP 0849208 6/1998
EP 1726554 11/2006
EP 2740702 6/2014
JP H0912271 1/1997
WO 2010129701 11/2010
WO 2015139842 9/2015
WO 2015149165 10/2015
WO 2016037207 A2 3/2016
WO 2016059652 4/2016

OTHER PUBLICATIONS

Written Opinion for PCT/EP2017/050246 dated Dec. 12, 2017 (5 pages).
International Search Report for PCT/EP2017/050246 dated Dec. 12, 2017 (10 pages).
Extended European Search Report for EP 16190590.6 dated Mar. 14, 2017 (10 pages).
English Translation of Abstract for JP H0912271 (1 page).
Chinese Search Report dated Dec. 7, 2020 for Application No. CN 2017800592114 and English translation.

* cited by examiner

B

FIBRE ROPE AND HOISTING SYSTEM INCLUDING SUCH A FIBRE ROPE

CROSS REFERENCE TO RELATED APPLICATIONS

This application is a 35 U.S.C. § 371 national stage application of PCT/NO2017/050246 filed Sep. 26, 2017 and entitled "Fibre Rope and Hoisting System Including Such a Fibre Rope", which claims priority to European Patent Application No. 16190590.6 filed Sep. 26, 2016, each of which is incorporated herein by reference in their entirety for all purposes.

STATEMENT REGARDING FEDERALLY SPONSORED RESEARCH OR DEVELOPMENT

Not applicable.

FIELD OF THE INVENTION

The present disclosure relates to a fibre rope. More particularly the present disclosure relates to a fibre rope particularly suitable for lifting operations, such as offshore hoisting operations. The disclosure also relates to a hoisting system for such lifting operations as well as to a method for operating such a hoisting system.

BACKGROUND

Offshore lifting cranes and their related equipment are getting increasingly larger and heavier in order to keep up with the requirements for lifting continually heavier loads, often in increasingly deep waters. Lifting cranes for deep water operations need winch drums suitable for storing several thousand meters of wire rope, often in the order of 3000 meters or more, thus requiring large, heavy winch drums with equally large footprints. For hoisting loads in deep water operations it is often desirable to use fibre ropes due to their reduced weight compared to traditional steel wire ropes.

A challenge related to the use of fibre ropes is the difficulty of measuring the wear of the fibre ropes, and in particular to predict the lifetime of the fibre ropes. In practice, the difficulty of the predicting the wear has led to requirements of higher safety factors compared to when working with wire ropes made from steel. Currently, the industry standard requires a safety factor between 5 and 6 when working with fibre ropes, implying the need for large diameter ropes and correspondingly large and heavy equipment for handling the fibre ropes. One of the reasons why it is hard to predict the lifetime of fibre ropes is their very sensitive dependency on temperature, resulting from internal friction between the rope fibres, friction between the rope and the sheaves that it runs over during hoisting operations as well as the ambient temperature. In particular when used in heave compensation mode, where the same portion of the fibre rope undergoes numerous bending cycles under load during a period of time that can endure a few days, the wear might become excessive. In contrast to steel, the fibres may undergo an irreversible recrystallization process already at temperatures in the order of 60° C.

Hoisting systems are known that use thermocouples to measure the temperature of wire ropes. The thermocouples have been shown to be difficult to install and hold in operation, including to pass over sheaves in the hoisting system. In addition, thermocouples embedded inside fibre ropes have been shown to influence premature failure of the ropes and thus the need for an even higher safety factor. Also, thermocouples repeatedly passing over sheaves in heave compensation mode have been shown to fail prematurely.

SUMMARY OF THE DISCLOSURE

The disclosure is directed to providing a remedy or to reduce at least one of the drawbacks of the prior art, or at least provide a useful alternative to prior art.

In a first aspect, the disclosure relates to a fibre rope for lifting operations, such as offshore lifting operations, wherein said fibre rope comprises a plurality of magnets embedded within the fibre rope with an axial distance therebetween along the fibre rope. The distance between the axially-spaced magnets will preferably be predefined.

The use of axially distributed magnets may be beneficial for measuring the distance between the magnets, where an increased distance indicates elastic or permanent elongation/creep of the rope. In order to obtain the desired distance data, the magnetic measurements may typically be combined with data about the rope hoisting speed as will be discussed below, though embodiments with a plurality of magnetic sensors provided with a fixed or variable distance therebetween are also envisioned which do not necessarily depend on the rope hoisting speed as input.

In at least one embodiment, said magnets may be permanent magnets with a temperature-dependent magnetic field strength. This may be particularly useful to monitor both information about the rope elongation as well as indirect information about the temperature of the fibre rope through the magnetic field strength. Any magnet with temperature-dependent magnetic field strength may be used, though neodymium-based magnets (also known as NdFeB, NIB or Neo magnets), may be preferable due to their superior magnetic properties and well documented temperature dependence. Neodymium magnets, which are the most widely used type of rare-earth magnet, are permanent magnets made from an alloy of neodymium, iron and boron to form the Nd2Fe14B tetragonal crystalline structure. Neodymium magnets are usually graded according to their maximum energy product, which relates to the magnetic flux output per unit volume. Higher values indicate stronger magnets and range from N35 up to N52. As embedded within a fibre rope according to the first aspect of the disclosure, it has been found that magnets of N42 and higher may be preferable due to their field strength, and thus better reliability as source for temperature and length measurements.

In one embodiment, said permanent magnets may be embedded in the core of said fibre rope, which may be useful to get an indirect measure of the core temperature of the fibre rope which would typically not be available from surface measurements. In particular, it may be beneficial to combine the indirectly measured core temperature with surface temperature measurements of the fibre rope as will be explained below. It may be a thermocouple or some other temperature sensor in contact with the fibre rope. However, preferably a non-contact temperature sensor, such as an IR sensor, may be used. By combining data about the core temperature of the fibre rope with data about the surface temperature, a radial gradient may easily be calculated as an indication of heat dissipation in the radial direction. Other locations for the embedded magnets are also envisioned, such as near the rope's outer surface, or mid-way between the rope's outer surface and the core. A temperature gradient along the fibre rope is already available from the magnetic temperature measurements and/or infrared temperature measurements along the rope.

In one embodiment, said fibre rope may further be provided with a plurality of fibre rope position identifiers, such as RFID tags, along the fibre rope. This may be useful for uniquely identifying different length portions of the wire rope. If combined with magnetic, and potentially other, length measurements, this may be particularly useful for localizing wear such as any excess temperature exposure and potential creep and twist of the fibre rope. Other position identifiers, such as uniquely optically identifiable marks may also be used.

In one embodiment, it may also be useful if the fibre rope is provided with a plurality of optically detectable marks provided with an axial distance therebetween along the fibre rope. The optical marks may serve as a back-up and/or redundancy for the distributed magnets for length measurements and may as such make the fibre rope more versatile and robust in terms of length measurements. It may be advantageous if positions of the optical marks substantially coincide with the positions of the embedded magnets along the fibre rope, which may simplify measurements and comparisons. The distance between the embedded magnets and potentially the optical marks may be in the order of 1 meter, though a variety of different distances may be used.

In one embodiment, the fibre rope may be provided with a continuous and optically detectable mark that extends along at least a portion of said fibre rope. This axial and optically detectable mark line may be used as an indicator for rope twist as will be explained below. "Optically detectable," as used herein, means that it is possible to distinguish it from the rest of the fibre rope by means of an optical sensor, such as by means of a camera, which does not necessarily have to operate in the part of the spectrum that is visible to a human eye.

In a second aspect, the disclosure relates to a hoisting system for lifting applications, including offshore applications, said hoisting system comprising a fibre rope according to the first aspect of the disclosure described above. The hoisting system further comprises:

a fibre rope hoisting speed sensor; and a magnetic sensor configured to sense the presence of said magnets embedded in the fibre rope.

Preferably the magnetic field strength and direction may also be sensed by said magnetic sensor. In the latter case a so-called 3D magnetic sensor may be used. One example of such a sensor is the three-dimensional hall effect sensor commercially available from Infineon Technologies AG. The 3-dimensional mapping may show to be particularly useful if the rope can be measured and codified at defined lengths using different magnetic orientations and numbers. The small magnetic temperature variations may thus be detected also by the 3-dimensional magnetic field variation, not only in one axis, but in three axes.

The magnetic sensor may in the simplest form be any device capable of sensing the presence of a magnetic field, which may then, together with the speed sensor, provide a simple, robust and non-contact, non-intrusive distance measurement between the embedded magnets in the fibre rope. This may be useful for indicating creep, permanent elongation or elastic elongation. Still, in a one embodiment, the magnetic sensor should also be adapted to sense the magnetic field strength, while at the same time the embedded magnets should have a temperature-dependent magnetic field strength, which may then give an indirect indication of the temperature of the magnets. A hall effect sensor may be used for such measurements, and as described above hall effect sensors are also known that may measure the spatial variation of the magnetic field. The indirect temperature measurements may typically require a simple calibration in order to uniquely determine the temperature based on magnetic field strength data, however for several known magnetic materials such data may already be available from look-up tables.

In one embodiment, the hoisting system may further be provided with a fibre rope position sensor for sensing different fibre rope positon identifiers to uniquely identifying different length portions of said fibre rope. The fibre rope position identifier may typically be a RFID reader adapted to uniquely identify passive RFID tags in the fibre rope, but also position sensors in the form an optical and position identifiers in the form of unique optical marks, such as number codes, may be used.

In a one embodiment, said hoisting system may further include an optical sensor configures to optically sense detectable marks on said fibre rope. The marks may be provided with an axial distance therebetween, as described above, and/or a continuous mark axially along the fibre rope. The marks with axial distance between them may be used for measuring elongation, while the axial continuous mark may be used to measure twist of the fibre rope. In certain embodiments, there may be provided a plurality of optical sensors distributed circumferentially around and/or axially along the fibre rope. A plurality of cameras may be beneficial for receiving an increased amount of data. Since the distance between each camera and the fibre rope will be predetermined during use, one or more of the cameras may also be used to record the shape of the fibre rope, wherein any ovality and shape change may be detected. In addition or as an alternative the optical sensor may include one or more lasers. The optically detectable marks may, but need not, be visually detectable.

In one embodiment said magnetic sensors, said fibre rope position sensors and said optical sensors may be provided within a common housing adapted for the passing of the fibre rope therethrough. The common housing may simply be provided as a box with holes for the passing of the fibre rope at two opposite ends and with different sensors, such cameras and sensors distributed axially along and circumferentially around the pathway of the fibre rope inside the housing. The housing may be beneficial for protecting the various sensing means, cameras and sensors, but the housing may also be useful for providing a pre-installed tool-kit with known characteristics and positions of the sensing means, including cameras and other sensors. It is therefore claimed that the housing with the various sensing means may even be useful with other types of wire ropes, i.e. other than fibre ropes, such as for steel ropes and composite (typically steel and fibre) ropes. The housing with different sensing means configurations as described in the following is therefore included as one embodiment of a hoisting system according to the second aspect of the disclosure as used together with a fibre rope according to the first aspect of the disclosure. However, the housing with different sensing means configurations as described herein may also be regarded as a separate disclosure independent of the fibre rope and useful for any kind of wire rope, also outside the offshore environment.

In one embodiment, the hoisting system may further comprise an infrared sensor configured to sense the surface temperature of said fibre rope. Said infrared sensor may also be provided inside said housing if present. The infrared sensor, where employed, will give an indication of the temperature in the outer radial portion of the fibre rope, and the temperature distribution along length direction of the rope when the rope is moving. In addition, if used together with magnetic field data as indirect temperature measurement, a temperature gradient in the radial direction of the fibre rope may also be easily calculated, which may be particularly useful for monitoring heat dissipation and the wear of the fibre rope. If the distributed magnets with a temperature-dependent magnetic field strength are embedded at or near the core of the fibre rope, the temperature gradient across the full radius of the fibre rope may be calculated.

In one embodiment, the hoisting system may be a knuckle-boom crane. Knuckle-boom cranes are known to be particularly useful in offshore environments, both because they occupy little deck space and because of their low centre of gravity compared to other cranes known to be used offshore. On a knuckle-boom crane, the main boom is hinged at the middle, thus creating a knuckle-boom. The luffing motion of both the main boom and the knuckle-boom is usually controlled with hydraulic cylinders. This way, movements of the load can be limited as the boom tip can be kept at a limited height above deck. This feature makes the crane both safe and efficient. The ability to knuckle in combination with the vessel's movement due to environmental conditions, imply that loads imposed to the crane structure will vary both in magnitude and direction. In one particular embodiment, the winch drum may supported and integrated substantially vertically in a support structure, such as the king, of the knuckle-boom crane as disclosed in PCT/N02016/050047, the disclosure of which being incorporated herein by this reference. In an alternative embodiment, the system may be a stand-alone winch system adapted to be used with any kind of crane or hoisting system.

All sensors and sensing means, including cameras, mentioned herein as part of the hoisting system according to the second aspect of the disclosure may be connected to one or more control units for processing of recorded data. The one or more control units, which typically may include one or more programmable logic controls and/or microcontrollers, may be provided within said common housing if present, or the control unit may be external to the housing and connected to the cameras and sensors wirelessly or with via various wires. The control unit may also be connected to or provided with a storage unit for storing measured data.

In particular, the hoisting system may include a control unit adapted to receive the measured magnetic field strength from the magnetic sensors and to calculate the temperature of the magnet, and thereby also the temperature at the core of the fibre rope, based on the measured magnetic field strength.

It should also be noted that the hoisting system may be provided with cooling means for cooling at least a portion of the hoisting system and/or for keeping at least a portion of the hoisting system at a controlled atmosphere. Cooling may be constant or it may be triggered when sensed temperature exceeds a predefined limit. In one embodiment, the whole winch and winch drum may be provided in a housing with a controlled, cooled atmosphere. Alternatively or in addition, the hoisting system may also be provided with means for cooling sheaves over which the fibre rope runs in heave compensation mode, where the friction-based temperature increase may become particularly emphasized. Cooling may be done by means of water- or electrolyte-based liquids, air jets or other cooling fluids.

In a third aspect the disclosure relates to a method for operating a hoisting system according to the second aspect of the disclosure, the method comprising the steps of:

- measuring the hoisting speed of said fibre rope by means of said fibre rope hoisting speed sensor;
- measuring the time between the passing of consecutive magnets by means of said magnetic sensor;
- calculating the distance between consecutive magnets by means of said measured hoisting speed and said measured time between the passing of said consecutive magnets; and
- comparing said calculated distance between the magnets with an original, predefined distance between the magnets.

The hoisting speed sensor may be any device adapted to measure and/or calculate the hoisting speed of the wire rope, directly or indirectly. In certain embodiments, the hoisting speed may be calculated from the measured rotational speed of a winch drum from which the fibre rope is reeled or a sheave over which the wire rope runs during a hoisting operation, such as by means of a tachometer or an encoder. The encoder may preferably be absolute, though an incremental one may also be useful in most embodiments.

In one embodiment, the method may further comprise the steps of:

- measuring the magnetic field strength of said magnets embedded in the fibre rope; and
- calculating the temperature of the magnets by means of said measured magnet field strength.

As mentioned above, the conversion from measured magnetic field strength to temperature may be based on pre-calibration of the magnets and/or data found in available look-up tables.

In one embodiment the method may also comprise the steps of:

- measuring the time between the passing consecutive optically detectable transverse marks on the fibre rope; and
- comparing the distance between consecutive transverse marks with an original value.

BRIEF INTRODUCTION OF THE DRAWINGS

In the following is described exemplary embodiments as illustrated in the accompanying drawings, wherein.

DETAILED DESCRIPTION OF THE DISCLOSED EXEMPLARY EMBODIMENTS

Figure 1A:
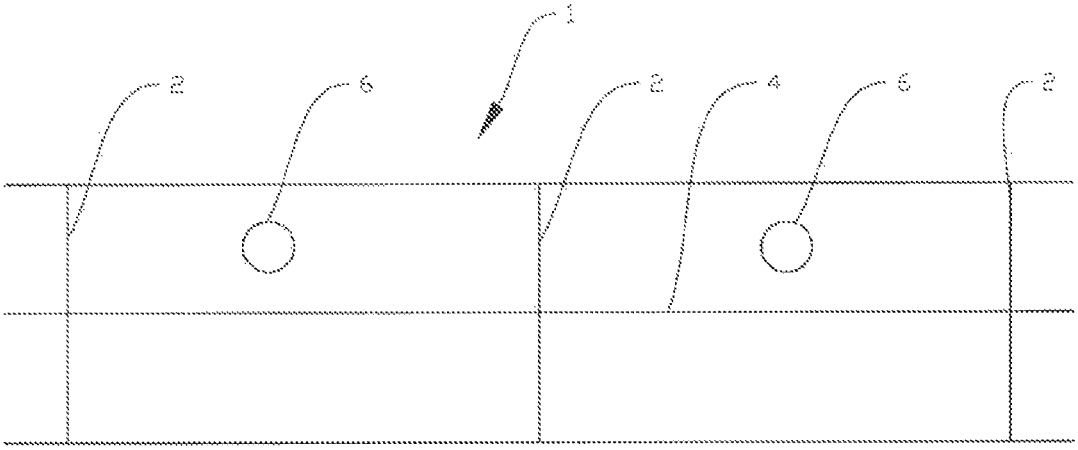
FIG. 1A shows, in a side view, a fibre rope according to the present disclosure.

In the following the reference numeral 1 will indicate a fibre rope according to the first aspect of the present disclosure, whereas the reference numeral 10 indicates a hoisting system according to the second aspect of the disclosure. Identical reference numeral will indicate identical or similar features in the drawings. The drawings are shown simplified and schematic and the various features in the drawings are not necessarily drawn to scale.

Figure 1B:
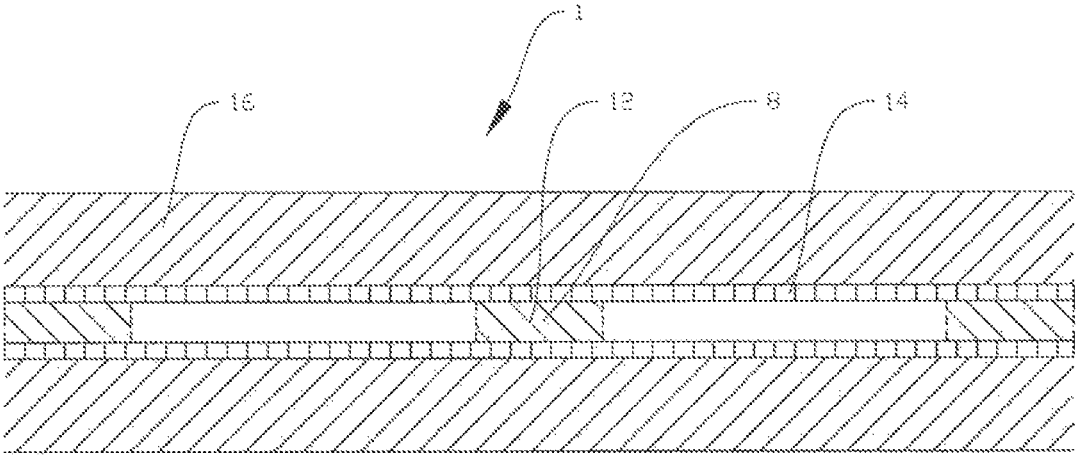
FIG. 1B shows, in a cross-sectional side view, the fibre rope from FIG. 1A.

The upper portion of FIG. 1A and FIG. 1B shows a part of a fibre rope 1, while the lower portion of the figure shows the same part of the fibre rope 1 in a cross-section along the rope. In the shown embodiment the fibre rope comprises High Modulus Polyethylene (HMPE) and/or High-Performance Polyethylene (HPPE) fibres, but it could also be based on any other type of fibre, such as e.g. ara-mid, liquid crystal polymer, polyamides, polyester, carbon etc. As can be seen from the upper portion of FIG. 1A and FIG. 1B, the outside of the fibre rope 1 is provided with optically detectable, transverse marks 2 with a fixed, axial distance therebetween. The distance in the shown embodiment is in the order of 1 meter and it will be predefined. Other predefined distances may be used in other hoisting systems 10. As will be explained in the following, the distance between consecutive marks 2 will be indirectly measured in real-time, where an increased length may be indicative excessive creep due to heating and/or load. In addition to the transverse marks 2 provided around the circumference of the fibre rope 1, the outside out the fibre rope 1 is also provided with an optically detectable continuous mark 4 along the axial length of the shown portion of the fibre rope 1. The continuous mark 4 may be used to measure local twisting of the fibre rope 1 as will also be explained below, where excessive twisting may also be a discard criteria. The fibre rope 1 is further provided with a plurality of fibre rope position identifiers 6, shown as RFID tags in this exemplary embodiment. The RFID tags 6 are embedded in the fibre rope 1, such as near the outer surface of the fibre rope, in order to uniquely identify various length portions of the fibre rope 1. The unique identification of various length portions of the fibre rope 1 becomes particularly useful in combination with the sensing of other fibre rope parameters, such as length extension, twist and temperature so as to be able to identify which portions of the fibre rope 1 are exposed to the mentioned wear-critical parameters. The distance between the RFID tags 6 along the fibre rope 1 may, but need not be, similar to the distance between the optically detectable transverse marks 2. In the shown embodiment, the optically detectable marks are also visually detectable.

The lower portion of FIG. 1A and FIG. 1B shows a cross-section along the length of the fibre rope 1. A plurality of magnets 8 are embedded in the fibre rope 1 substantially at the core 12, i.e. the radial centre, of the fibre rope 1. In the shown embodiment, the magnets 8 are separated from the rest of the fibre rope 1 by means of a protective sleeve 14, which may be particularly useful if the fibre rope is to be submerged in water. The sleeve 14 will create an impediment between the magnets 8 and sea water, thus preventing deterioration and magnetic field loss of the magnets. The sleeve 14 may typically comprise a polymeric material which is flexible and compact. The magnets 8 are of a permanent type with a temperature-dependent magnetic field strength, which makes it possible to measure the core temperature of the fibre rope by means of magnetic field strength measurements, typically with one or more hall-effect sensors connectable to a control unit as will be explained below. The axial distance between the magnets along the rope may coincide with the distance between the transverse visual marks 2. The combined use of both visual transverse marks 2 and embedded magnets 8 gives redundancy in the fibre rope 1 elongation monitoring. Fibre ropes 1 are already known that are provided with an internal sleeve 14 for improving radial stiffness of the rope. As such, the magnets 8 may be included inside such a sleeve 14, thus exploiting the already existing infrastructure.

Figure 2:
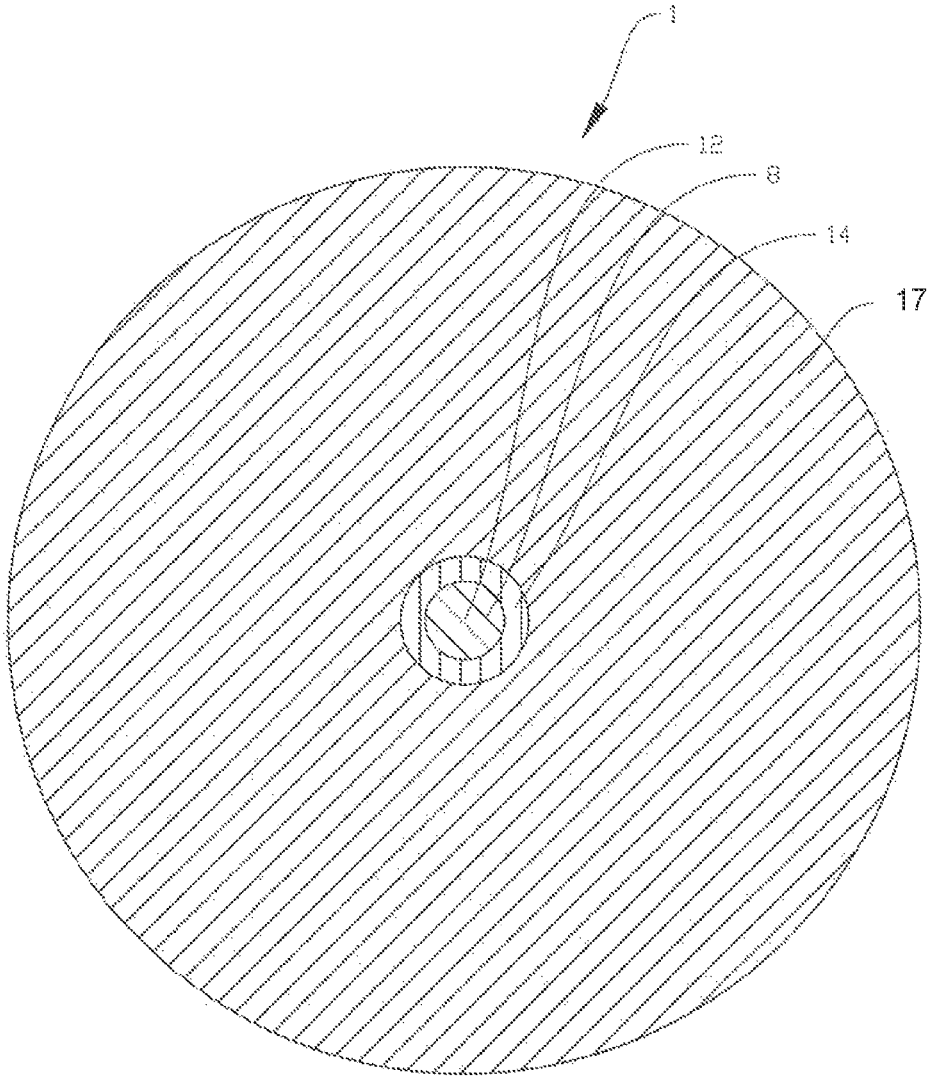
FIG. 2 shows, in a cross-sectional view and in larger scale, the fibre rope from FIG. 1A.

FIG. 2 is a cross-section, in a larger scale than FIG. 1, of the fibre rope 1 in a plane perpendicular to the length of the fibre rope 1. The magnet 8 is shown in the protective sleeve 14 surrounded by HMPE fibre 17.

Figure 3:
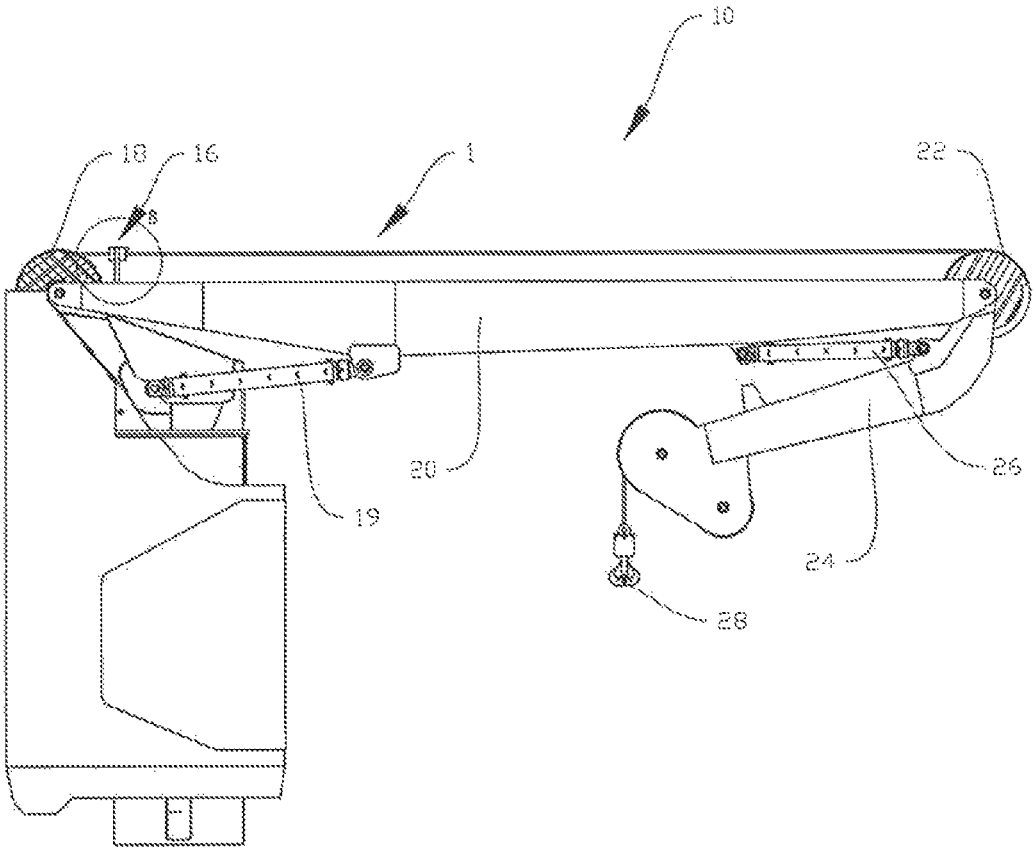
FIG. 3 shows, in a side view, a hoisting system according to the second aspect of the disclosure.

FIG. 3 shows a hoisting system 10 according to the second aspect of the disclosure, the hoisting system 10 comprising a fibre rope 1 according to the first aspect of the disclosure. In the shown exemplary embodiment the hoisting system 10 is provided as a knuckle-boom crane 10, though the fibre rope 1 could be used in any kind of hoisting system, including on any kind of crane and also in stand-alone winch systems. This particular kind of knuckle-boom crane 10, which is provided with a not shown winch drum orientated with the drum axis substantially vertical and with the winch drum as an integrated part of the crane support structure, was described in PCT/N02016/050047. The knuckle boom crane 10 may be use to lower and lift heavy loads to and from a seabed several thousand meters below sea-level. The knuckle-boom crane 10 will be moving together with the vessel on which is it placed due the impact of waves and wind. In certain parts of such a hoisting operation it may be necessary to keep the load substantially fixed relative to the seabed or to another reference system not moving together with the knuckle-boom crane 10. It may therefore be necessary to operate the knuckle-boom crane 10 in heave compensation mode, implying that the same portion of the fibre rope 1 undergoes numerous bending cycles under load, which may lead to excessive heating and potentially unacceptable wear of portions of the fibre rope 1.

To monitor the temperature, elongation, twist and potentially also shaped change of the fibre rope 1, a housing 16, including a plurality of various sensors as will be explained in the following, is installed near a guiding sheave 18 on a main boom 20 of the knuckle-boom crane 10. Several such housings 16 may be installed along the length of the wire on the knuckle-boom crane 10 for measuring simultaneously on multiple locations along the fibre rope 1, but only one is used in the shown embodiment. Another housing 16 could e.g. be placed near a second guiding sheave 22 at the distal end of the main boom 20 where the knuckle-boom 24 is rotatably connected. The luffing motion of the knuckle-boom crane 10 is enabled by means of a first cylinder 19 adapted to lift and lower the main boom 20, while the knuckle-boom crane 10 is further provided with a second cylinder 26 for articulating the knuckle-boom 10 relative to the main boom 20 as will be understood by a person skilled in the art. A load suspension member 28 in the form of a hook is connected to the end of the fibre rope 1 hanging from the distal end of the knuckle-boom 24 for the connection of a not shown load to the fibre rope 1. The knuckle-boom crane 10 is also adapted to slew in the horizontal plane relative to a not shown pedestal.

Figure 4:
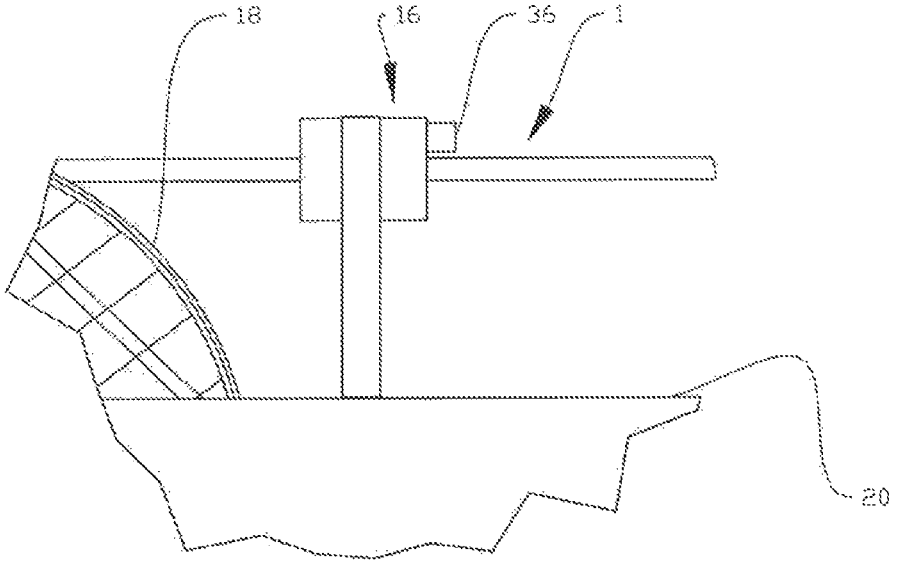
FIG. 4 shows a detail from FIG. 3.

FIG. 4 shows an enlarged portion of the encircled part B from FIG. 3. The figure shows schematically the fibre rope 1 running through the housing 16 covering multiple sensors. The housing 16 is placed immediately after the guiding sheave 18 on the main boom 20 in the direction from the not shown winch drum towards the second guiding sheave 22 and the load suspension member 24 as shown in FIG. 3.

Figure 5:
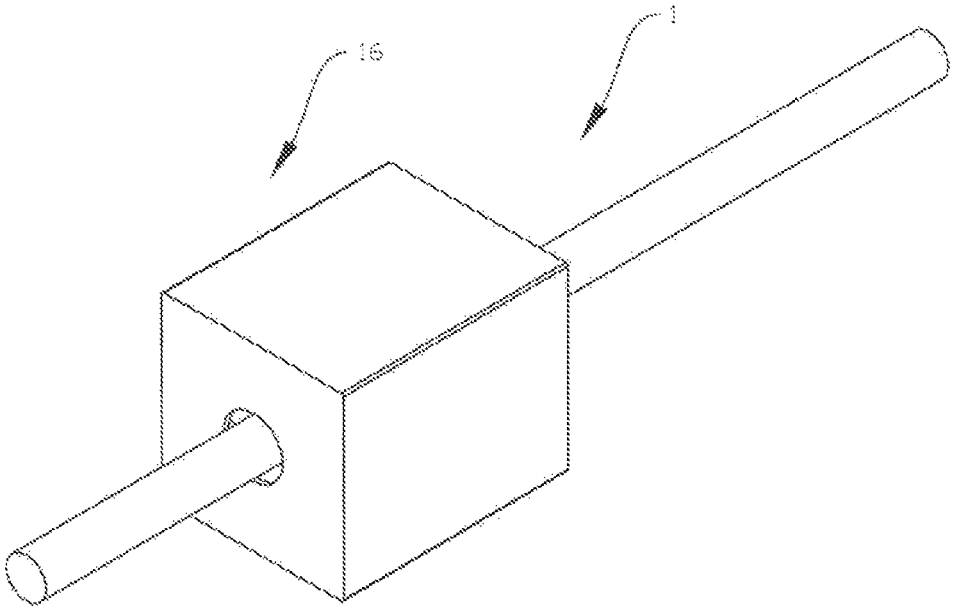
FIG. 5 shows, schematically, a housing with a fibre rope running therethrough.
Figure 6A:
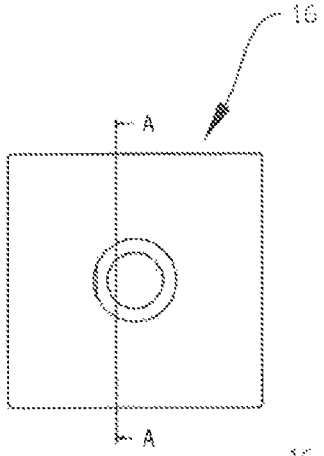
FIG. 6A shows, in a top view, a housing, including several sensors, with a fibre rope running therethrough.
Figure 6B:
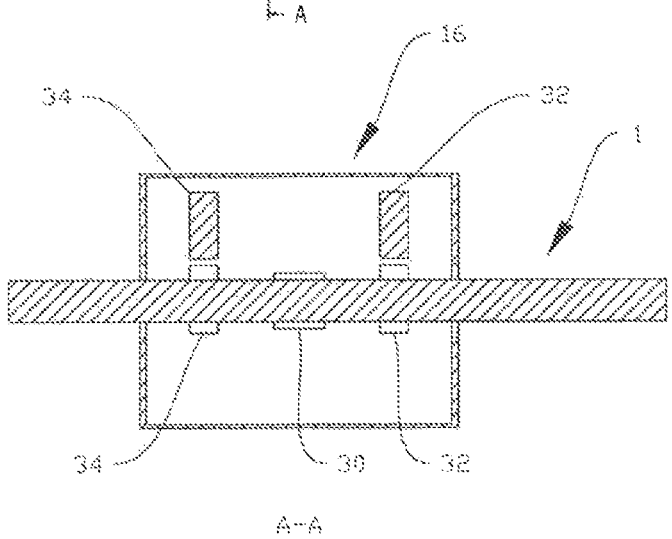
FIG. 6B shows, in a cross-sectional side view, the housing from FIG. 6A.
Figure 7:
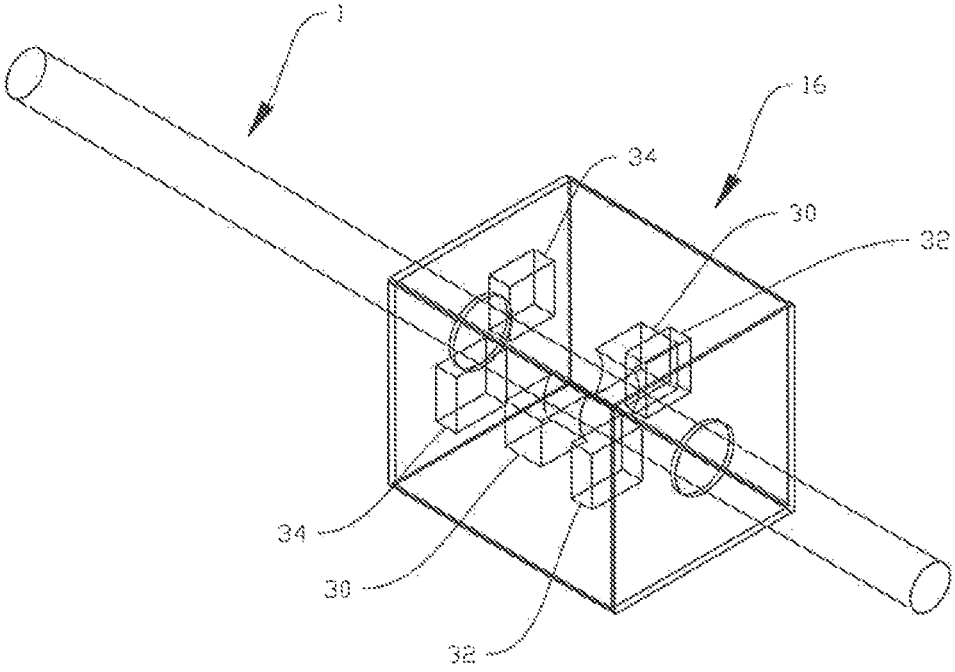
FIG. 7 shows, in a perspective and partially transparent view, a housing with a fibre rope running therethrough

The housing 16 with the fibre rope 1 running therethrough is shown in a perspective view in FIG. 5 and in a semi-transparent perspective view in FIG. 7, while FIG. 6A and FIG. 6B shows the housing 16 and fibre rope 1 in an end-view in an upper portion of the figure and in a cross-section through the line A-A in the lower portion of the figure. Inside the housing 16, there is provided two magnetic sensors 30. The magnetic sensors 30 are adapted to sense the passing of the magnets 8 through the housing 16. The hoisting system 10 is also provided with a not shown control unit including a timer function for measuring the time between the passing of consecutive magnets. Combined with input about fibre rope 1 speed, this makes it possible to calculate the distance between the embedded magnets 8, and hence also any change in distance. In the exemplary embodiment shown, the magnets 8 are of a permanent type with a magnetic field strength dependent on temperature. The magnetic sensors 30 are therefore, in this shown embodiment, of a type adapted to measure the magnetic field strength of the magnets 8. This makes it possible to calculate the core temperature of the fibre rope 1 in a reliable, efficient and non-intrusive way. The conversion from measured magnetic field strength to temperature may be found in a simple pre-calibration experiment, or it may also be found in look-up tables for certain frequently used permanent magnets as mentioned herein. Normally, the hoisting system include a control unit adapted to receive the measured magnetic field strength from the magnetic sensor and to calculate the temperature of the magnet, and thereby also the temperature at the core of the fibre rope, based on the measured magnetic field strength.

Also, in the shown embodiment the magnetic sensors 30 are adapted to sense the direction of the magnetic field. The sensors used in this specific embodiment are three-dimensional magnetic hall effect sensors commercially available from the company Infineon Technologies AG. The housing is also provided with a fibre rope position sensor, here in the form of a RFID sensor/reader 32 for uniquely identifying the RFID tags 6 embedded in the fibre rope 1. Giving each length portion of the fibre rope 1 its own unique recognizable signature is very useful for knowing which portions of the fibre rope 1 that are subject to wear, creep, twist etc. at any time. Preferably the not shown control unit is connected to or comprises a storage unit adapted to store measured and calculated data from the different portions of the fibre rope 1, such as temperature data, elongation data, twist data, number of bending cycles under load data etc. Data from different time intervals may be compared so as to detect change. The housing 16 is further provided with cameras 34 for monitoring the transverse and continuous visual marks 2, 4. A plurality of such cameras may be distributed circumferentially around the fibre rope in the housing 16. In the shown embodiment only two cameras are used, but in alternative embodiments more cameras 34 may be used. In a particularly useful embodiment four cameras 34 may be placed evenly around the fibre rope 1 with 90° between each. The cameras 34 may be used in the same way as the magnets 8 to measure the distance between the transverse marks 2 so as to monitor any elongation of the fibre rope 1. The cameras 34 also monitor the axial continuous mark 4. The time from when one and the same camera 34 sees the continuous mark 4 to the next time the same camera 34 sees the continuous mark 4, i.e. the time between each 360° twist of the fibre rope, can be used to calculate the twist per meter. Once the camera 34 stops seeing the continuous mark 4 a control unit timer starts. The timer stops when the same camera 34 sees the continuous mark again. The cameras 34 will also monitor the shape and ovality of the fibre rope 1, while the control unit compares the latest data with the original shape and ovality of the fibre rope 1. The shape change, such a reduction in diameter, may also be compared with the elongation of the fibre rope 1. An increase in diameter compared to a set value will typically be an indication of slack in the fibre rope 1 or degraded fibres which may also be cross-checked by a not shown load cell value. The shape of the fibre rope 1 is determined by different images captured by cameras 34 circumferentially arranged with a defined angle therebetween, and/or with the inclusion of a not shown laser beams. The shape change is observed by image analysis in a control unit as will be mentioned below.

The knuckle-boom crane 10 is further provided with an infrared (IR) sensor 36 for measuring the surface temperature of the fibre rope 1. In the shown embodiment the IR sensor 36 is provided outside the housing 16, however the IR sensor could equally well be included inside the housing 16. While the hall effect sensors 30 indirectly measure the core temperature of the fibre rope 1, the IR sensor 36 mainly measure the surface temperature of the fibre rope 1. By combining the two different temperature measurements, a temperature gradient in the radial direction of the fibre rope 1 may be calculated to give an indication about the heat dissipation. The temperature gradient in the length direction of the fibre rope 1 may now also be measured both at the core and at the surface.

In normal operation, the speed of the fibre rope 1 is used as input for length measurements in combination with a timer. The rope speed is, in this embodiment, input from a not shown tachometer. The length measurements are used as input both for monitoring elongation and twist, but also in combination with the temperature measurements and monitoring of bending cycles under load to give an overall overview of wear and creep of the fibre rope 1. The RFIDs tags 6 and readers 32 are continuously used to identify different length portions of the fibre rope 1. Both excessive creep and twist are used as discard criteria for the worn portion of the fibre rope 1. The worn portion of the fibre rope 1 may be cut away and the two remaining ends may be spliced as will be known by a person skilled in the art. Examples of discard criteria may be 10% creep and/or 1 full twist per 10 meters, but these parameters will depend greatly on and vary between different types of fibre ropes 1. Excessive heating may also be a separate discard criterion due to the irreversible recrystallization mentioned introductorily. It should be noted that the mentioned limits may vary greatly between different hoisting systems 10 and in particular between different types of fibre ropes 1.

In a particular embodiment, the hoisting system 10 includes one or more not shown cooling members. Some portions of the hoisting system 10, such as the winch drum, may be stored in a housing with a constantly controlled and cooled atmosphere. Other parts of the hoisting system 10, such as the area around the guiding sheaves 18, 22 where the fibre rope 1 undergoes numerous bending cycles and the temperature in-creases due to internal and external friction in the fibre rope 1, may be cooled when the fibre rope reaches a pre-set temperature. The conditional cooling will typically take place when the hoisting system 10 is set in heave compensation mode, where it may operate for several hours. Cooling may be done by means of flushing with water, electrolytes, air jets or other cooling fluids.

It should be noted that the above-mentioned embodiments illustrate rather than limit the disclosure, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements.

The mere fact that certain measures are recited in mutually different dependent claims does not indicate that a combination of these measures cannot be used to advantage.

The invention claimed is:

1. A hoisting system comprising:

a fibre rope comprising a plurality of magnets embedded within the fibre rope with an axial distance therebetween along the fibre rope, wherein each of the plurality of magnets is a permanent magnet with a temperature-dependent magnetic field strength;

a magnetic field sensor configured to sense the presence of the magnetic field of said magnets that are embedded in the fibre rope;

a fibre rope hoisting speed sensor configured to measure the hoisting speed of the fibre rope; and a control unit configured to calculate the temperature of the plurality of magnets based on the magnetic field strength of the plurality of magnets measured by the magnetic field sensor, wherein the control unit is further configured to measure the time between the passing of consecutive magnets of the plurality of magnets embedded in the fibre rope as sensed by the magnetic field sensor, calculate the distance between the consecutive magnets based on the hoisting speed measured by the fibre rope hoisting speed sensor and the measured time between the passing of said consecutive magnets, and compare the calculated distance between the consecutive magnets with an original, predefined distance between the consecutive magnets.

2. Hoisting system according to claim 1, wherein the hoisting system further comprises a position sensor configured to sense different fibre rope position identifiers so as to uniquely identify different portions of said fibre rope.

3. Hoisting system according to claim 1, wherein said hoisting system further comprises an optical sensor configured to sense optically detectable marks that are on said fibre rope.

4. Hoisting system according to claim 1, wherein the hoisting system further comprises:

a position sensor configured to sense different fibre rope position identifiers so as to uniquely identify different portions of said fibre rope; and an optical sensor configured to sense optically detectable marks that are on said fibre rope;

wherein said magnetic field sensor, said position sensor, and said optical sensor are embedded within a common housing that is configured for receiving the fibre rope therethrough.

5. Hoisting system according to claim 1, wherein the hoisting system further comprises an infrared sensor configured to sense the temperature of said fibre rope.

6. The hoisting system of claim 5 wherein the infrared sensor is configured to sense the external surface temperature of said fibre rope.

7. Hoisting system according to claim 1, wherein the hoisting system comprises a knuckle-boom crane or a stand-alone winch system.

8. The hoisting system of claim 1 wherein the magnetic field sensor is configured to sense the magnetic field strength of the magnetic field of said magnets that are embedded in the fibre rope.

9. The hoisting system of claim 1 wherein the magnetic field sensor is configured to sense the orientation of the magnetic field of said magnets that are embedded in the fibre rope.

10. Hoisting system according to claim 1, wherein said permanent magnets are embedded in the core of said fibre rope.

11. Hoisting system according to claim 1, wherein said fibre rope further comprises a plurality of fibre rope position identifiers spaced along the fibre rope.

12. Hoisting system according to claim 1, wherein the fibre rope further comprises a plurality of optically detectable marks provided with an axial distance therebetween along the fibre rope.

13. Hoisting system according to claim 12, wherein the axial positions of said optically detectable marks substantially coincide with the axial positions of said magnets along the fibre rope.

14. Hoisting system according to claim 1, wherein said fibre rope further comprises a continuous and optically detectable mark along at least a portion of said fibre rope.

15. Method for operating a hoisting system, the method comprising:

measuring the magnetic field strength of a plurality of magnets embedded within and axially spaced along a fibre rope, wherein each of the plurality of magnets is a permanent magnet with a temperature-dependent magnetic field strength;

calculating the temperature of the plurality of magnets based on the measured magnetic field strength of the plurality of magnets;

measuring the hoisting speed of the fibre rope by means of the fibre rope hoisting speed sensor;

measuring the time between the passing of consecutive magnets of the plurality of magnets that are embedded in the fibre rope by means of a magnetic field sensor;

calculating the distance between the consecutive magnets by means of said hoisting speed sensor and said measured time between the passing of said consecutive magnets, and comparing said calculated distance between the consecutive magnets with an original, predefined distance between the consecutive magnets.

* * * * *